US008684616B2

(12) United States Patent
Caulier

(10) Patent No.: US 8,684,616 B2
(45) Date of Patent: Apr. 1, 2014

(54) APPLICATOR FOR APPLYING A COMPOSITION TO THE EYELASHES AND/OR THE EYEBROWS

(75) Inventor: Eric Caulier, Maignelay (FR)

(73) Assignee: L'Oreal, Paris (FR)

( * ) Notice: Subject to any disclaimer, the term of this patent is extended or adjusted under 35 U.S.C. 154(b) by 615 days.

(21) Appl. No.: 12/958,836

(22) Filed: Dec. 2, 2010

(65) Prior Publication Data

US 2011/0164914 A1 Jul. 7, 2011

Related U.S. Application Data

(60) Provisional application No. 61/291,564, filed on Dec. 31, 2009.

(30) Foreign Application Priority Data

Dec. 8, 2009 (FR) ..... 09 58731

(51) Int. Cl.
*A46B 11/00* (2006.01)

(52) U.S. Cl.
USPC ..... 401/129; 401/126

(58) Field of Classification Search
USPC ..... 401/126, 129, 121, 122, 268; 132/218, 132/216, 219, 126; 15/207.2
See application file for complete search history.

(56) References Cited

U.S. PATENT DOCUMENTS 6,328,495 B1 12/2001 Gueret
6,375,374 B2 4/2002 Gueret
7,231,926 B2 * 6/2007 Kim ..... 132/218
8,141,561 B2 * 3/2012 Thorpe et al. ..... 132/218
2002/0023657 A1 2/2002 Gueret
2004/0244809 A1 12/2004 Gueret
2004/0258453 A1 12/2004 Gueret
2005/0028834 A1 2/2005 Ramet
2005/0066990 A1 3/2005 Rousselet
2005/0175394 A1 8/2005 Gueret
2006/0013639 A1 1/2006 Gueret
2007/0062551 A1 3/2007 De Brouwer et al.
2007/0062552 A1 3/2007 De Brouwer et al.
2007/0157945 A1 7/2007 Lhoyer et al.
2008/0083421 A1 4/2008 Malvar et al.
2008/0245382 A1 10/2008 Marciniak-Davoult et al.

(Continued)

FOREIGN PATENT DOCUMENTS

EP 1 475 013 A1 11/2004
EP 1 510 149 A1 3/2005

(Continued)

OTHER PUBLICATIONS

European Search Report issued in Application No. 10 19 3743; Dated Feb. 7, 2011 (With Translation).

*Primary Examiner* — David Walczak
(74) *Attorney, Agent, or Firm* — Oliff PLC

(57) ABSTRACT

An applicator for applying a composition to human keratinous materials, in particular the eyelashes or the eyebrows includes a stem and an applicator member that is carried by the stem. The applicator member includes a support, made as a single part, including an internal branch and a second branch; and an applicator portion that is engaged, at least in part, between the internal branch and the second branch. The applicator portion extends all around the internal branch, over at least a fraction of the length of the applicator portion where it is engaged between the branches.

16 Claims, 7 Drawing Sheets

(56) References Cited

U.S. PATENT DOCUMENTS

| | | | |
|---|---|---|---|
| 2008/0271746 | A1 | 11/2008 | Gueret |
| 2009/0194128 | A1 | 8/2009 | Vandromme |
| 2009/0214284 | A1 | 8/2009 | Gueret |
| 2010/0310296 | A1 | 12/2010 | Gueret |

FOREIGN PATENT DOCUMENTS

| | | | |
|---|---|---|---|
| EP | 1 602 300 | A1 | 12/2005 |
| EP | 1 935 279 | A1 | 6/2008 |
| FR | 2 809 938 | A1 | 12/2001 |
| FR | 2 890 837 | A1 | 3/2007 |
| FR | 2 890 838 | A1 | 3/2007 |
| FR | 2 913 572 | A1 | 9/2008 |
| FR | 2 916 328 | A1 | 11/2008 |
| FR | 2 922 422 | A1 | 4/2009 |
| WO | WO 2004/077987 | A1 | 9/2004 |
| WO | WO 2006/090343 | A1 | 8/2006 |
| WO | WO 2007/125206 | A2 | 11/2007 |
| WO | WO 2009/078528 | A1 | 6/2009 |

* cited by examiner

Fig. 6
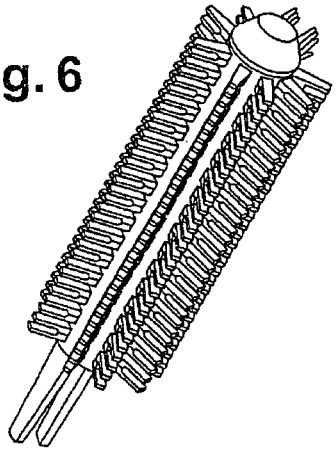
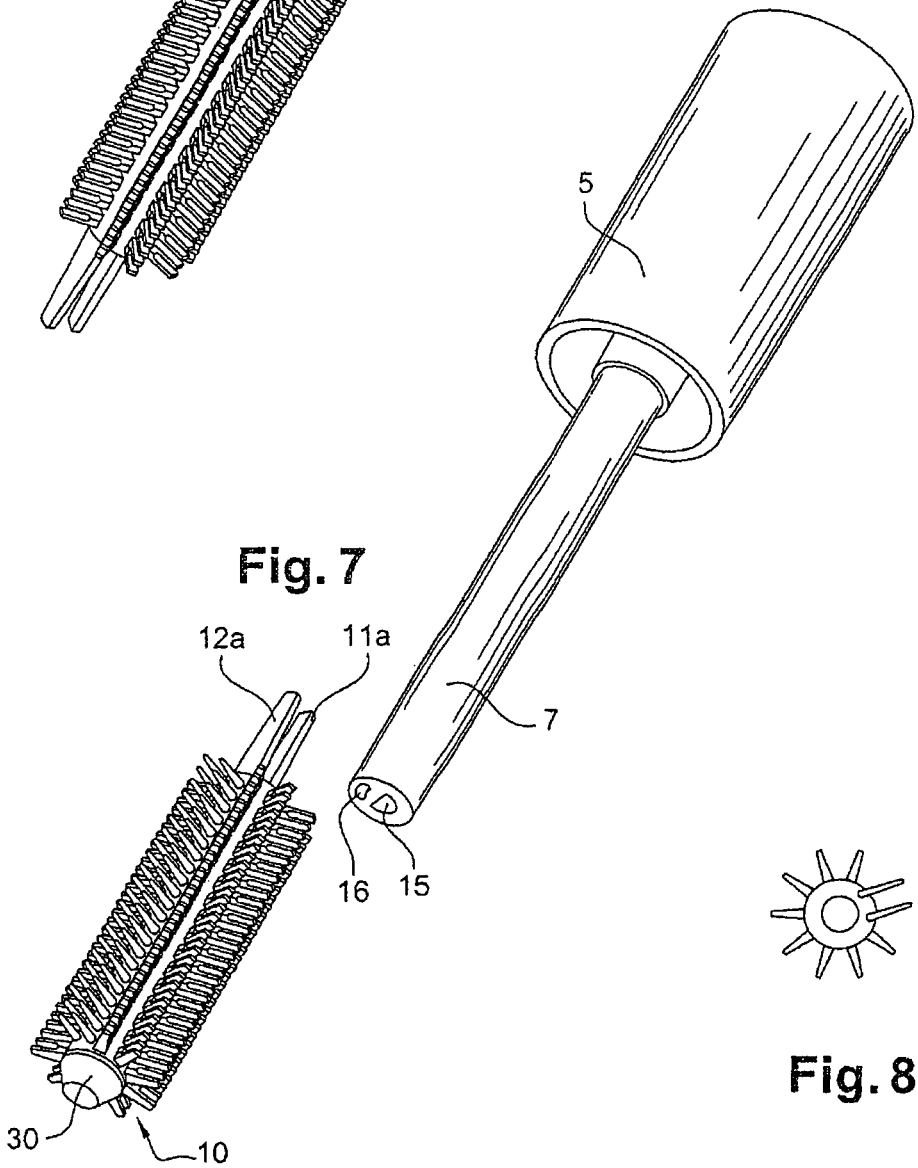
Fig. 7
Fig. 8
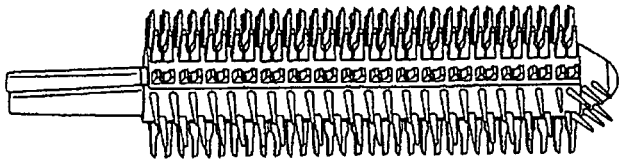
Fig. 9

APPLICATOR FOR APPLYING A COMPOSITION TO THE EYELASHES AND/OR THE EYEBROWS

FIELD OF THE INVENTION

The present invention relates to applicators that are used in cosmetics for applying a makeup or a care-product composition to human keratinous materials, such as the skin, the lips, and keratinous fibers, and more particularly, but not exclusively, it relates to applicators for applying a composition to the eyelashes or the eyebrows.

BACKGROUND OF THE INVENTION

Applicators are known including an applicator member that is made, at least in part, by molding a plastics material.

Thus, it has been proposed to mount on a support, an applicator portion that is molded out of a thermoplastic material.

Application FR 2 890 838 describes an applicator of this type. The support may be formed by a pin that is fastened at one end in a housing of the stem of the applicator, and that, at its opposite end, includes a wide head for retaining the applicator portion on the pin. In certain situations, in particular when the applicator portion is made using a thermoplastic material that swells on coming into contact with the composition containing the container, the applicator portion may go past the wide head of the pin and become disengaged from the applicator.

Consequently, there exists a need to guarantee reliable fastening of the applicator portion on the applicator.

Application EP 1 935 279 describes an applicator member comprising an applicator portion that is mounted on a core. The applicator portion is fastened by being inserted into the stem.

Application EP 1 602 300 discloses an applicator member having an applicator portion that is made by being overmolded onto a core.

Application FR 2 916 328 describes a twisted-core brush that extends inside a support capable of carrying applicator elements, the support comprising two branches that come around the twisted core when the support is in place on the brush.

Application WO 2007/125206 describes a brush including a twisted metal core that traps a core that is molded with bristles.

Application FR 2 809 938 describes an applicator comprising a molded applicator portion that is fitted on a support that is also molded, but that is of different hardness.

Publications EP 1 475 013 A1, FR 2 913 572, and FR 2 809 938, for example, disclose applicators including a hybrid applicator member comprising both an applicator portion made of thermoplastic material and a twisted-core brush.

There also exists a need to benefit from novel applicators that offer additional possibilities in terms of controlling the eyelashes and/or of makeup effects.

OBJECT AND BRIEF SUMMARY OF THE INVENTION

The invention thus seeks to improve still further applicators including a fitted applicator portion.

Exemplary embodiments of the invention provide an applicator for applying a composition to human keratinous materials, e.g. the eyelashes or the eyebrows, the applicator comprising:

- a stem; and
- an applicator member that is carried by the stem, the applicator member comprising:

- a support comprising at least one internal branch and a second branch, preferably an external branch; and
- an applicator portion that is engaged, at least in part, between the internal branch and the second branch, the cross-section of the applicator portion extending all around the internal branch, over at least a fraction of the length of the applicator portion where it is engaged between the branches.

In other words, for the entire fraction that is engaged between the branches, the applicator portion extends continuously all around the internal branch, or does so for only a part of the fraction that is engaged between the branches. The applicator portion may be engaged between the branches over its entire length.

The second branch preferably presents at least a fraction of its surface that is not covered by the applicator portion.

The second branch extends about the longitudinal axis of the applicator member over an angular sector that is less than 360°.

The applicator portion may be engaged between the branches over at least half of its length, or even over its entire length.

The support may be not twisted. The support may be fitted on the stem.

The support may be made as a single piece, i.e. it may be constituted by a single block made of one or more materials.

The invention enables the applicator portion to be held in simple and effective manner, and enables the applicator portion to be made in various shapes. The support may also be made with various shapes.

The applicator portion may be easier to make and/or may be made more accurately than when made by over-molding on the support, since it may be molded separately from the support.

The applicator portion may be made out of an elastomer material, in particular a material that is particularly flexible.

The support may comprise at least three branches, or even more. At least two branches, or even all of the branches minus one may be external branches.

The second branch may carry at least one applicator element, e.g. at least one row of teeth, e.g. at least two parallel rows of teeth. The second branch may equally well have no applicator elements.

The branches may be rectilinear or not. Their spacing may be constant or varying.

The two branches may be interconnected, at the distal end, via a distal portion that is molded integrally with the branches. The distal portion may itself be made with teeth, or with other applicator elements, where appropriate.

The applicator portion may have to be put into place on the support, before said support can be mounted on the stem.

The second applicator portion may include a longitudinal groove in which the second branch is engaged. This may improve the hold of the applicator portion on the support, and may make it possible to have teeth carried by the external branch, which teeth have bases that are situated substantially at the same distance from the longitudinal axis of the applicator member as teeth of the applicator portion, for example.

Where appropriate, the applicator portion may comprise a plurality of segments that are stacked on the support, e.g. of different hardnesses.

One of the branches may be hinged about the other branch, prior to mounting the support on the remainder of the applicator. Alternatively, the branches may be not hinged about each other.

The external second branch may be hinged to the internal branch, the external branch being provided with fastener means that make it possible to hold it in a folded-down position on the internal branch after the applicator portion has been put into place on the internal branch.

The applicator portion may include flocking or a porous material. In exemplary embodiments of the invention, the applicator portion includes a sleeve made of foam, felt, metal, or ceramic.

The invention also provides a device for applying a composition to the eyelashes or the eyebrows, the device comprising:

a container containing the composition to be applied; and an applicator as defined above.

The applicator may be configured to close the container.

The stem may include two housings for receiving two respective endpieces that extend the branches at the proximal end of the support. The housings may be molded integrally with the stem. The stem may equally well include a single housing. The presence of two housings makes it possible to orientate the applicator member relative to the stem.

The container may include a wiper member.

In other exemplary embodiments, and independently or in combination with the above, the invention also provides a packaging and applicator device, comprising:

a stem including two housings in its end; and an applicator member that is carried by the end of the stem, the applicator member comprising: a support including two branches; and an applicator portion that is carried by the support; each of the branches including a mounting endpiece that is fastened in a corresponding housing of the stem.

In the above, the support and the applicator portion may differ in their color, their chemical composition, and their flexibility. By way of example, one may be hard and the other soft, or one soft and the other semi-flexible.

In order to mold the applicator portion, it is possible to use a thermoplastic material that is optionally relatively rigid, e.g. styrene-ethylene-butylene-styrene (SEBS); a silicone rubber; latex rubber; butyl rubber; ethylene-propylene-terpolymer rubber (EPDM); a nitrile rubber; a thermoplastic elastomer; a polyester, polyamide, polyethylene, or vinyl elastomer; a polyolefin such as polyethylene (PE) or polypropylene (PP); polyvinyl chloride (PVC); ethyl vinyl acetate (EVA); polystyrene (PS); polyethylene terephthalate (PET); polyoxymethylene (POM); polyamide (PA); or polymethyl methacrylate (PMMA). In particular, it is possible to use materials known under the trade names Hytrel®, Cariflex°, Alixine°, Santoprene®, Pebax®, this list not being limiting. It may be advantageous to implement the invention with an applicator portion that is made out of a material that is more flexible than the material out of which the support is made. Thus, the applicator portion is advantageously made out of thermoplastic elastomer. Where appropriate, the applicator portion may be made out of a plurality of materials, e.g. a plurality of segments made out of different materials.

The hardness of the applicator portion may lie in the range 20 on the Shore A scale (ShA) to 90 on the Shore D scale (ShD), or even in the range 30 ShA to 80 ShD.

The applicator portion may present magnetic properties. By way of example, the magnetic properties may result from a filler of magnetic particles, e.g. of ferrites, that are dispersed in the plastics material.

At least one of the support and of the applicator portion may be flocked and/or may include a filler for improving sliding, for example.

BRIEF DESCRIPTION OF THE DRAWINGS

The invention can be better understood on reading the following detailed description of non-limiting embodiments thereof, and on examining the accompanying drawings, in which:

FIG. 6 is another perspective view of the applicator member;

FIG. 7 shows the applicator member and the stem for receiving it;

FIG. 8 is an end view of the applicator member, as seen looking along arrow VIII of FIG. 1;

FIG. 9 is a side view of the applicator member;

MORE DETAILED DESCRIPTION

Figure 1:
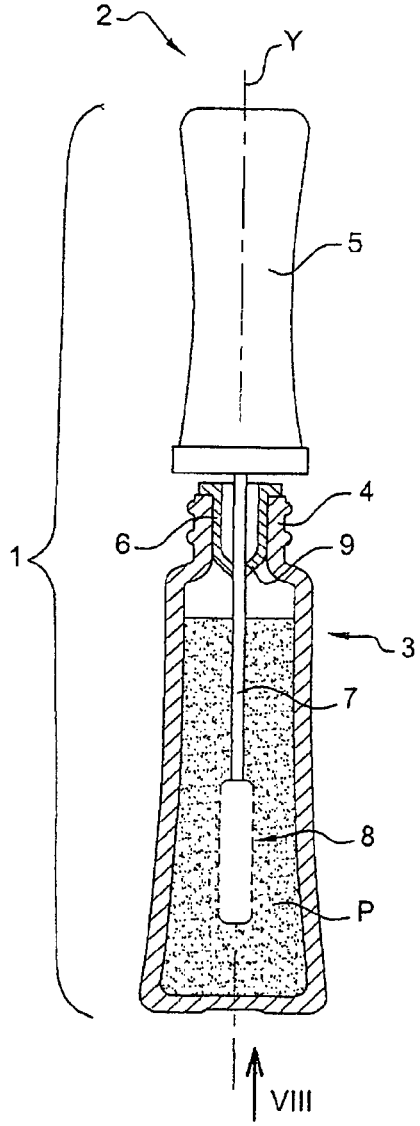
FIG. 1 is a diagrammatic and fragmentary longitudinal section of an example of a packaging and applicator device including an applicator made accordingly to the invention.

FIG. 1 shows a packaging and applicator device 1 made in accordance with the invention, the device comprising an applicator 2 and an associated container 3 containing a cosmetic composition P, e.g. to be applied to the eyelashes and/or the eyebrows, e.g. mascara or a care product.

In the embodiment under consideration, the container 3 may include a threaded neck 4, and the applicator 2 includes a closure cap 5 that is arranged to be fastened on the neck 4 so as to close the container 3 in a leaktight manner when not in use, the closure cap 5 also constituting a handle for the applicator 2.

The applicator 2 includes a stem 7 of longitudinal axis Y, which stem is connected at its top end to the closure cap 5, and at its bottom end to an applicator member 8.

The container 3 also includes a wiper member 6 that is inserted into the neck 4.

In the embodiment under consideration, the wiper member 6, which may be of any type, includes a lip 9 that is arranged to wipe the stem 7 and the applicator member 8 while the applicator 2 is being removed from the container 3. The lip 9 defines a wiper orifice of a diameter that is adapted to the diameter of the stem.

In the embodiment shown, the stem 7 presents a cross-section that is circular, but it would not be beyond the ambit of the present invention for the stem 7 to present some other section, the cap 5 thus possibly being fastened on the container 3 other than by screw-fastening, if necessary. The wiper member 6 could be adapted to the shape of the stem 7 and to the shape of the applicator member 8, where appropriate.

In the embodiment under consideration, the longitudinal axis Y of the stem 7 is rectilinear and coincides with the longitudinal axis of the container 3 when the applicator 2 is in place thereon, but it would not be beyond the ambit of the present invention for the stem 7 to be non-rectilinear, e.g. forming a bend. The longitudinal axis of the applicator member may form an angle with the longitudinal axis of the stem, where appropriate.

Where appropriate, the stem 7 may include an annular narrowing at its portion that comes to be positioned facing the lip 9 of the wiper member 6, so that said wiper member is not mechanically stressed unduly during storage.

The wiper member may be as described in patent applications or US patent Nos. 2005/0028834, 2005/0175394, 2004/0258453, U.S. Pat. Nos. 6,375,374, 6,328,495, for example.

Figure 2:
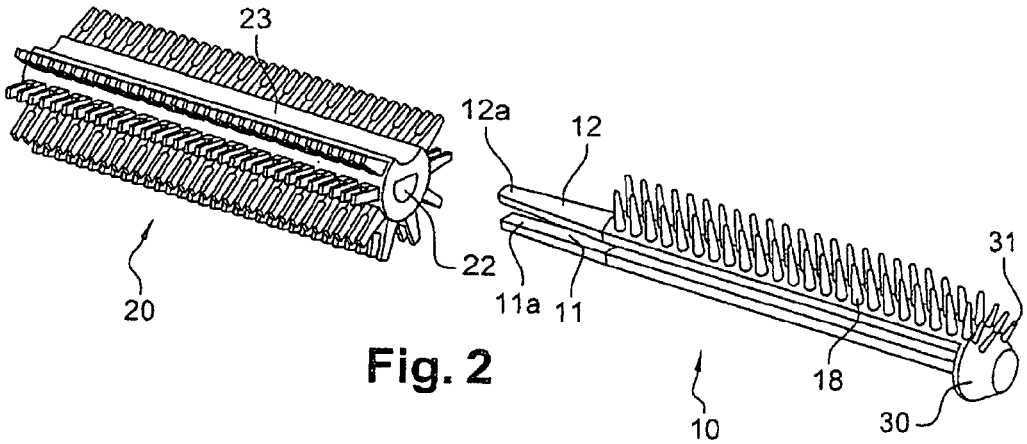
FIG. 2 is an exploded view of the applicator member of the applicator of FIG. 1.
Figure 3:
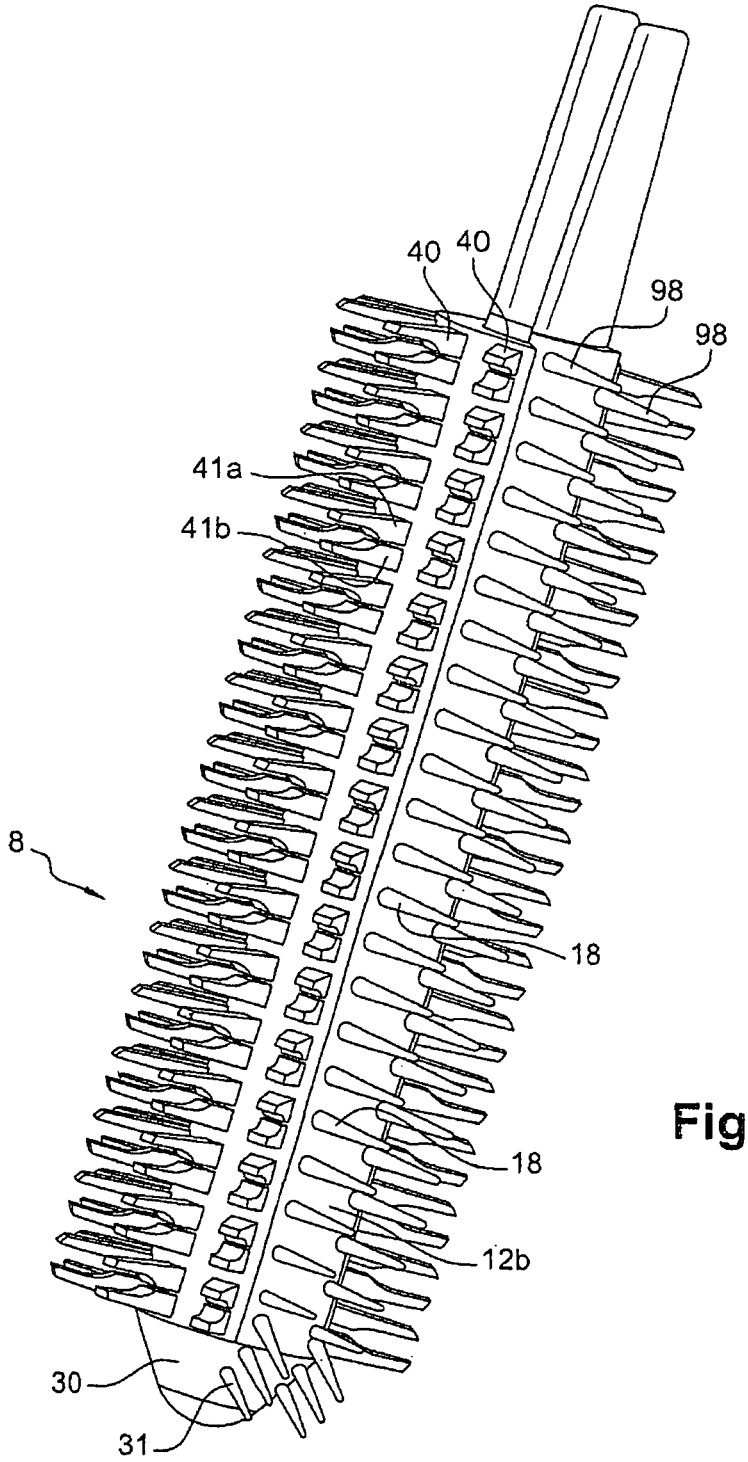
FIG. 3 is a perspective view of the applicator member in its assembled state and shown in isolation.
Figure 4:
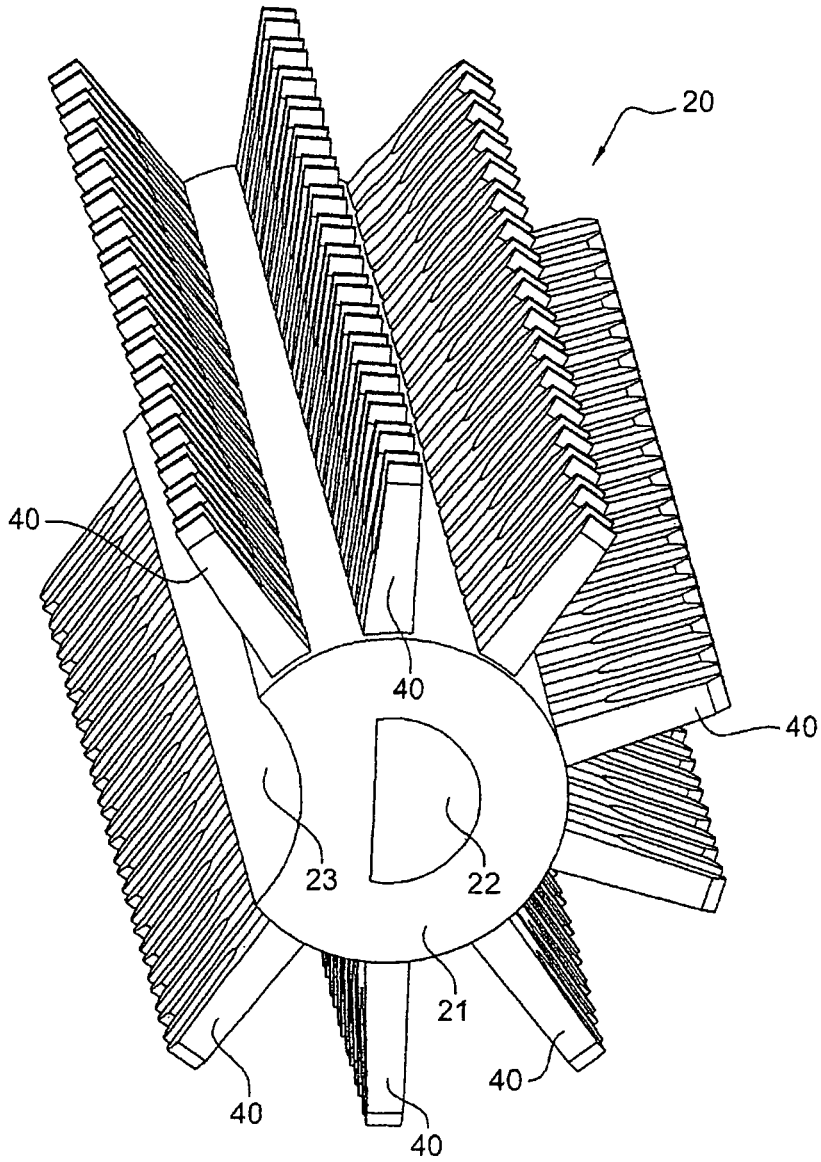
FIG. 4 shows the applicator portion in isolation.
Figure 5:
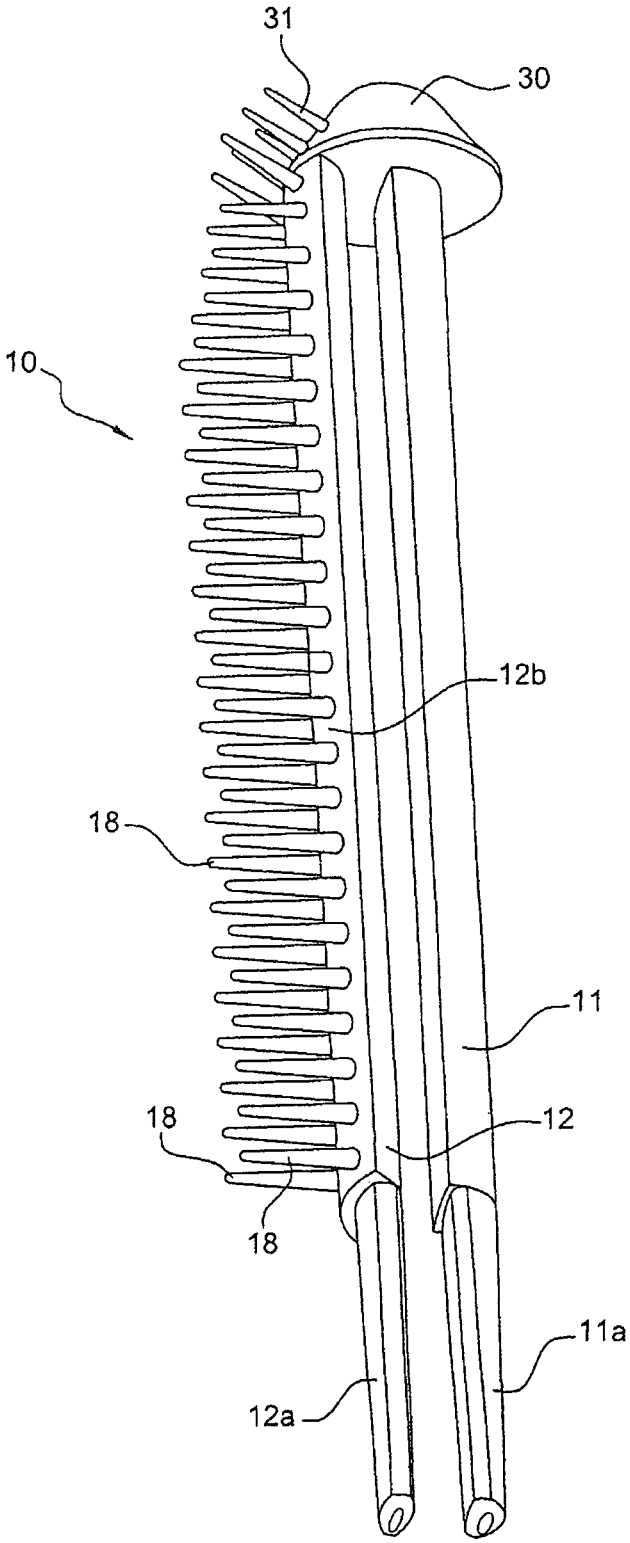
FIG. 5 shows the support in isolation.

As can be seen in FIG. 2, the applicator member 8 comprises a support 10 and an applicator portion 20 for assembling with the support 10 so as to constitute the applicator member 8.

The support 10 comprises an internal first branch 11 and an external second branch 12 that define between them a space that makes it possible to engage the support 10 on the applicator portion 20.

More particularly, in the embodiment shown, the applicator portion 20 includes a body 21 through which there passes a longitudinal opening 22 of cross-section with an outline that is closed, and the internal branch 11 is for engaging in the opening 22, so as to project from the proximal end of the applicator member 8.

The body 21 presents a longitudinal groove 23 for receiving the external branch 12.

At the proximal end, each of the branches 11 and 12 presents a respective endpiece 11*a* and 12*a* for mounting in the stem 7, said stem including respective housings 15 and 16 for receiving the endpieces 11*a* and 12*a*. In variants, the stem may equally well have only a single housing.

In the embodiment shown, the housings 15 and 16 are of different sections that match the sections of the endpieces 11*a* and 12*a*. By way of example, the more central housing 15 is of section greater than the section of the more off-center housing 16.

The support 10 may be fastened on the stem in various ways, the endpieces 11*a* and 12*a* being adhesively-bonded on the stem 7, for example, or said stem being stamped on the endpieces. Fastening may be performed in some other way, e.g. by over-molding the stem 7 on the support 10, by heat sealing, by snap-fastening, by stapling, or by screw-fastening.

The internal branch 11 may not have any applicator elements, as shown, the external branch 12 only carrying them.

The external branch 12 may present a longitudinal face 12*b* on which there are connected applicator elements 18, e.g. disposed in two rows 98, e.g. axially offset from, and parallel to, each another, such that the teeth extend in staggered succession along the longitudinal face 12*b*.

The teeth 18 may be oriented substantially parallel to a mid-plane for the branch 12, which mid-plane contains the longitudinal axis of the applicator member 8. The majority of the teeth 18 that are connected to the longitudinal face 12*b* may extend in the same direction.

The support 10 may include a distal portion 30 of generally tapering shape, so as to make it easier to put back into the container. In line with each of the rows 98, the distal portion 30 may carry a few teeth 31 that are connected, e.g. generally perpendicularly, to the underlying surface of the support 10. By way of example, the teeth 31 may extend only on the top side of the distal portion 30, when the longitudinal axis of the applicator member 8 is horizontal, as in FIG. 2, for example.

The applicator portion 20 includes rows 40 of applicator elements that are grouped into pairs of applicator elements 41*a* and 41*b* for example, in accordance with the teaching of patent application FR 2 890 837 or FR 2 890 838.

In the embodiment shown, the applicator portion 20 includes eight rows 40 of teeth, but the invention is not limited to some particular number of rows, and the applicator portion 20 may include 0 to 20 rows.

The applicator portion 20 may be made out of any material, and in particular out of a thermoplastic elastomer material, as mentioned above.

The support 10 may be made out of a material that is different from the material of the applicator portion 20, e.g. out of a harder, non-elastomer, thermoplastic material.

In general, the length of the applicator portion 20 may lie in the range 5 mm to 35 mm, e.g. lying in the range 20 mm to 25 mm. The length of the support 10 may be greater.

Figure 18:
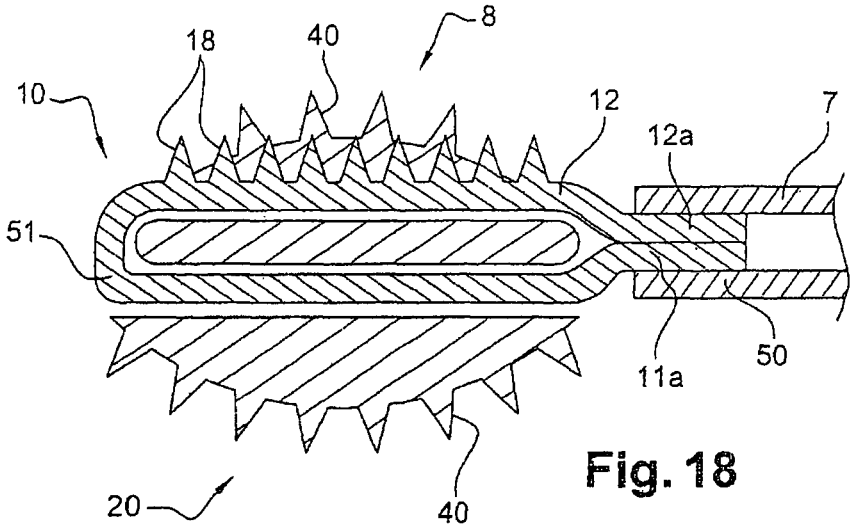
FIG. 18 is a diagrammatic and fragmentary longitudinal section of a variant embodiment.
Figure 19:
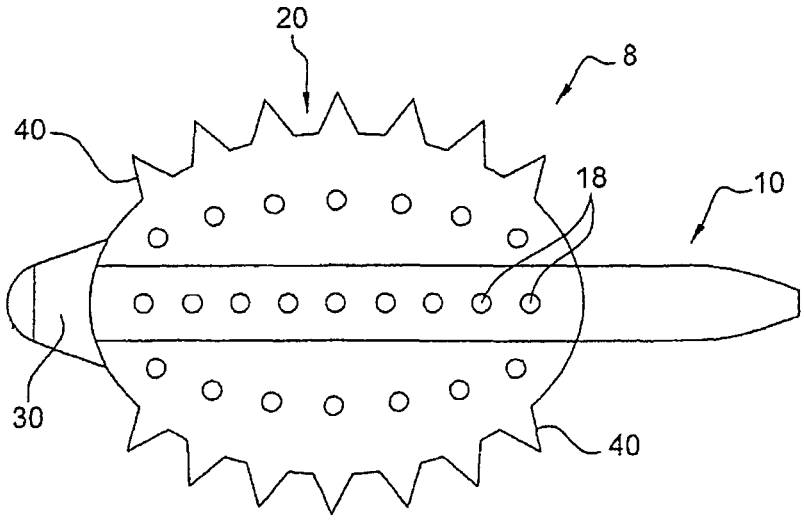
FIG. 19 is a top view of this embodiment.

The general shape of the envelope surface of the applicator member may vary, e.g. it may be optionally circularly cylindrical, egg shaped, frustoconical, bifrustoconical, prismatic, peanut shaped, or ball shaped, as shown in FIGS. 18 and 19. In cross-section, the envelope surface may be circular or non-circular over at least a fraction of its length.

The support 10 may comprise applicator elements 18 having an end which protrudes or not above adjacent row 40 of teeth belonging to the applicator portion 20.

The longitudinal axis of the applicator member 8 may be rectilinear or curved.

The handle may include a marker enabling the user to determine the orientation of the external branch of the support more easily. The stem may be mounted on the handle in marked manner. The asymmetry of the housings 15 and 16 impose a marked mounting of the applicator member on the stem.

Figure 10:
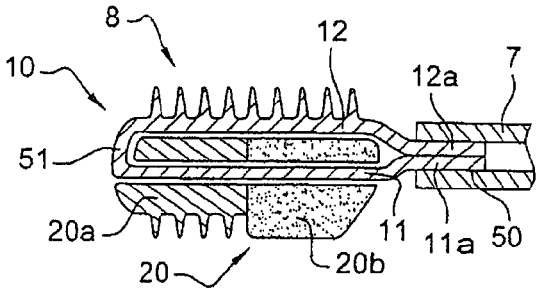
FIG. 10 is a diagrammatic and fragmentary longitudinal section of a variant embodiment.

In the variant embodiment shown in FIG. 10, it can be seen that the mounting endpieces 11*a* and 12*a* of the branches 11 and 12 are received in a single housing 50 of the stem 7.

Figure 11:
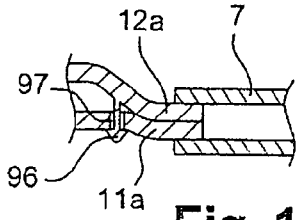
FIGS. 11 and 11A show details of variant embodiments.
Figure 11A:
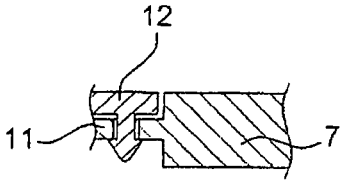

The branches 11*a* and 12*a* may be connected, at the distal end, by a distal portion in the form of a hinge 51 that makes it possible to mold the support 10 flat, then to fold the branches in half one against the other after mounting the applicator portion 20 on the support 10, for example.

Where appropriate, and as shown in FIG. 11, the branches 11 and 12 may be configured to be assembled together at the proximal end of the applicator member, prior to mounting in the stem. For example, one of the branches may include a peg 96 that is configured to snap-fasten in a housing 97 of the other branch. This may make it easier to mount the applicator member in the stem. The branches may also be held together at the proximal end by adhesive, by staking, by heat-sealing, or by means of a ring mounted on the mounting endpieces.

Where appropriate, and as shown in FIG. 11A, one of the branches is molded integrally with the stem and the other branch is folded down and fastened onto the stem or the first branch after the applicator portion has been put into place.

Figure 12A:
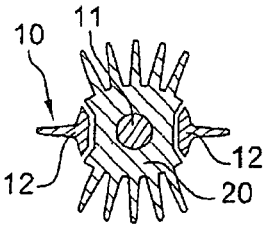
FIGS. 12A, 12B, 16 and 17 are cross-sections of the applicator member in variant embodiments.

The number of branches may be greater than 2, e.g. equal to 3. For example, it is possible to have an internal branch 11 and two external branches 12, as shown in FIG. 12A, each of the external branches 12 optionally carrying applicator elements.

Figure 12B:
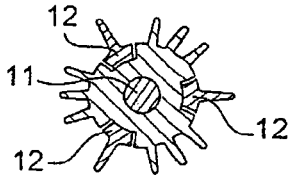

The number of external branches 12 may be higher than two, e.g. equal to three, as shown in FIG. 12B, or equal to four or more (variants that are not shown).

Figure 13:
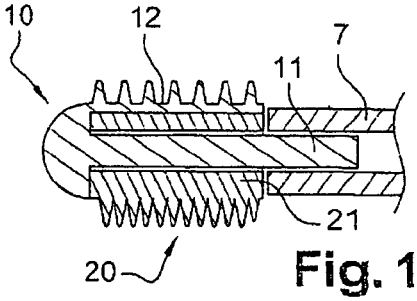
FIGS. 13 to 15 are fragmentary and diagrammatic longitudinal sections of variant embodiments of the applicator member.

The support 10 may have only one branch that is fastened to the stem 7, e.g. the internal branch 11, as shown in FIG. 13.

Figure 14:
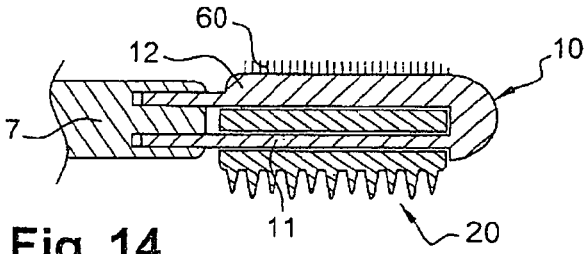

FIG. 14 shows the possibility of one of the support and of the applicator portion not including teeth, but an application surface that is formed by flocking 60, for example, that covers the external branch 12, for example.

Figure 15:
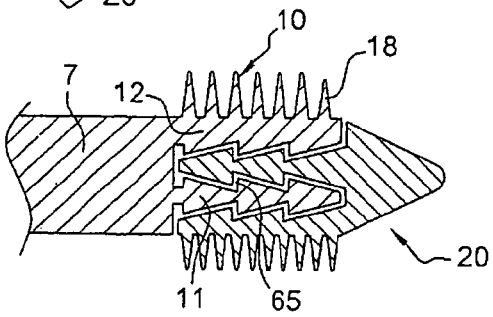

FIG. 15 shows the possibility of molding the stem 7 integrally with the support 10. Also shown is the possibility for at least one of the branches 11 and 12 of the support to include portions in relief 65 that make it possible to fasten the applicator portion 20 on the support 10, e.g. by snap-fastening.

The applicator portion 20 may also be formed by a porous material, e.g. a sleeve made of a foam, a felt, or a ceramic. The applicator portion 20 may also be formed by a piece of composition, e.g. a sleeve of solid mascara, e.g. a casting.

The applicator portion 20 may include at least two segments that are stacked on the support 10.

By way of example, FIG. 10 shows an applicator portion 20 that is formed of a distal segment 20*a* and a proximal segment 20*b*. By way of example, the proximal segment 20*b* is made out of a material that is different from the material of the distal segment 20*a*. By way of example, the proximal segment is made out of a foam, and without any applicator elements.

The applicator member may include a plurality of applicator portions 20 that are engaged on a plurality of respective branches of the support.

Figure 16:
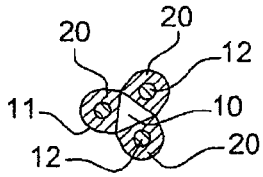

By way of example, FIG. 16 shows an applicator member in which the support 10 includes at least two branches 11, 12, each carrying an applicator portion 20.

Thus, one applicator portion 20 has the branch 11 passing therethrough, and the other branch 12 is external to this applicator portion.

In the embodiment of FIG. 16, the applicator member includes three applicator portions 20 that are engaged on three respective branches of the support 10. Each of the applicator portions 20 is constituted by a sleeve, for example. Where appropriate, the applicator portions 20 may present application properties that are different. They may optionally be made with applicator elements.

Figure 17:
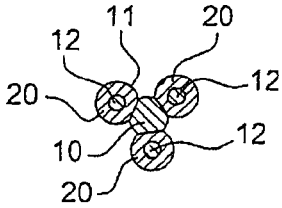

In the variant in FIG. 17, the support 10 also includes branches 12 that are engaged through the applicator portions 20, a central branch 11 extending between the applicator portions 20.

By way of example, the applicator portions 20 are rollers each capable of turning on the branch that carries it, the rollers optionally coming into contact with one another other.

In order to use any one of the above-described devices 1, the user may unscrew the closure cap 5 and remove the applicator member 8 from the container 3.

After the applicator member 8 has passed through the wiper member 6, a certain quantity of composition remains on the applicator member 8, and may be applied to the eyelashes or the eyebrows by the user.

In a variant, vibration could be applied to the applicator member during application, combing, or while taking the composition, e.g. as described in application WO 2006/090343.

Naturally, the invention is not limited to the embodiments described above.

In particular, the characteristics of the various embodiments may be combined together within variants that are not shown.

During application, the stem may be rotary and turned by an appropriate mechanism relative to a grip surface of the applicator.

The expression "comprising a" should be understood as being synonymous with "comprising at least one" unless specified to the contrary.

What is claimed is:

1. An applicator for applying a composition to human keratinous materials, the applicator comprising:

a stem; and an applicator member that is carried by the stem, the applicator member comprising:

a support, made as a single part, comprising an internal branch and a second branch; and an applicator portion that includes applicator elements and that is engaged, at least in part, between the internal branch and the second branch, the applicator portion extending all around the internal branch, over at least a fraction of the length of the applicator portion where it is engaged between the branches.

2. An applicator according to claim 1, the applicator portion being made out of an elastomer material.

3. An applicator according to claim 1, the second branch having at least one portion of its surface not covered by the applicator portion.

4. An applicator according to claim 1, the second branch carrying at least one applicator element.

5. An applicator according to claim 1, the branches being rectilinear.

6. An applicator according to claim 1, the two branches being interconnected, at a distal end of the support, via a portion that is molded integrally with the branches.

7. An applicator according to claim 6, the support including applicator elements on the portion interconnecting the branches.

8. An applicator according to claim 1, the applicator portion including a longitudinal groove in which the second branch is engaged.

9. An applicator according to claim 1, the applicator portion comprising a plurality of segments that are stacked on the support.

10. An applicator according to claim 1, one of the branches being hinged about the other branch.

11. An applicator according to claim 10, the second branch being hinged to the internal branch, the second branch being provided with a fastener that makes it possible to hold it in a folded-down position on the internal branch after the applicator portion has been put into place on the internal branch.

12. An applicator according to claim 1, the applicator portion including flocking or a porous material.

13. An applicator according to claim 1, the stem including two housings for receiving two respective endpieces that extend the branches at a proximal end of the support.

14. A device for applying a composition to the eyelashes or the eyebrows, the device comprising:

a container containing the composition to be applied; and an applicator as defined in claim 1.

15. A device according to claim 14, the applicator being configured to close the container.

16. An applicator according to claim 1, for applying a composition to the eyelashes or the eyebrows.

* * * * *